United States Patent [19]

Sporkenbach et al.

[11] Patent Number: 4,493,805

[45] Date of Patent: Jan. 15, 1985

[54] METHOD AND OVEN FOR MANUFACTURING A LIGHT CONSTRUCTION ELEMENT, PARTICULARLY A COVER PLATE

[75] Inventors: Gustav-Adolf Sporkenbach, Lister Meile 21, D-3 Hannover 1, Fed. Rep. of Germany; Dieter Suetterlin, Frick, Switzerland

[73] Assignees: Keller Holding AG, Pfungen, Switzerland; Gustav-Adolf Sporkenbach, Hanover, Fed. Rep. of Germany; a part interest

[21] Appl. No.: 456,015

[22] PCT Filed: May 10, 1982

[86] PCT No.: PCT/CH82/00067

§ 371 Date: Dec. 20, 1982

§ 102(e) Date: Dec. 20, 1982

[87] PCT Pub. No.: WO82/03885

PCT Pub. Date: Nov. 11, 1982

[30] Foreign Application Priority Data

May 8, 1981 [CH] Switzerland ..... 2986/81

[51] Int. Cl.[3] ..... B29H 7/20

[52] U.S. Cl. ..... 264/25; 264/44; 264/60

[58] Field of Search ..... 264/25, 44, 60

[56] References Cited

U.S. PATENT DOCUMENTS

| | | | |
|---|---|---|---|
| 1,448,684 | 3/1923 | Beecher | 264/60 |
| 1,459,357 | 6/1923 | Booze | 264/60 |
| 4,187,266 | 2/1980 | Greskovich | 264/44 |

*Primary Examiner*—John A. Parrish
*Attorney, Agent, or Firm*—Werner W. Kleeman

[57] ABSTRACT

The method of moldless manufacturing light construction elements comprises a first step of mold-free shaping a blank comprising a first layer of an expandable first clay material and a second layer of a non-expandable second clay material. The blanks are supported at their second layers and conveyed through an oven with radiation heating of the blanks at least from above, so that the first layer progressively expands as the blanks are conveyed through the oven. After cooling, the expanded blank is further processed to assume the required final dimensions.

12 Claims, 4 Drawing Figures

10
12
14
16
18
20
2
4
4a
6
8
22
24
26
28
30
32
34
36
38
40
42
44
46
48
50
52
54
56
II

METHOD AND OVEN FOR MANUFACTURING A LIGHT CONSTRUCTION ELEMENT, PARTICULARLY A COVER PLATE

BACKGROUND OF THE INVENTION

The present invention relates to a new and improved method of, and apparatus for, manufacturing a light construction element, particularly a cover plate.

The present invention relates specifically to a new and improved method of, and apparatus for, manufacturing a light construction element, particularly a cover plate, in which a blank comprising an upper layer of an expandable first clay material and a lower layer of a second clay material which is incapable of expanding at least in the range of the expansion temperature of the first clay material is fired in an oven such that the first clay material expands and is sintered to the second clay material at the interconnecting surface.

The initially mentioned subjects are known as, for example, from British Patent No. 1,279,980 and German Patent Publication No. 1,933,421, respectively. In the procedure as described therein, for instance, a layer of an expandable first clay material is arranged on a layer consisting of a second clay material which is not capable of expansion at the swelling temperature of the first clay material. There the layer of the second clay material is introduced into a mold and, then, the first clay material is deposited thereupon in the form of particles or pieces. Such method, however, did not render useful results since, on the one hand, a large surface is formed which oxidizes on firing and, thereby, prevents swelling due to the cavities intermediate the particles and, on the other hand, due to the cavities the heat transfer is too poor to ensure sufficient and particularly uniform swelling. Due to the cavities the further described radiation heating cannot become sufficiently effective, particularly, since the side walls of the mold also have a cooling action.

SUMMARY OF THE INVENTION

Therefore, with the foregoing in mind it is a primary object of the present invention to provide a new method of, and apparatus for, manufacturing a light construction element, particularly a cover plate, which enables or at least improves the manufacture of such light construction elements.

Now in order to implement these and still further objects of the invention, which will become more readily apparent as the description proceeds, the method of the present development is manifested by the features that, the upper layer is designed as a dimensionally or form-stable massive body and the blank is expanded and fired resting on its lower layer without the use of a mold.

By designing the upper layer of the blank as a form-stable massive body the surface of the layer is kept small, on the one hand, whereby optimum heat absorption and uniform expansion through a great thickness are achieved. Due to the form-stability of the first layer, furthermore, a mold wall can be dispensed with, whereby cooling of the blank is avoided and the heat supply and the expansion process are further improved and the adherence of the expanded body to the mold is avoided. The method ensures uniform expansion through a great thickness of the blank so that, for example, an increase in volume to the sevenfold of the unexpanded layer is possible.

Advantageously, the clay material of the first layer contains porosity generating agents which are known and may comprise, for instance, burn-out materials like particles of wood, coal, paper, cork, rice shells and the like. However, styropor is specifically advantageous since it acts as an absorbing agent for heat absorption. The porosity generating agents are spherically shaped with further advantage.

The manufacture of the light construction element is particularly simple and economical since the two clay material layers can be combined in a simple manner by extrusion to form a blank.

Preferably, at least one of the layers prior to extrusion is provided with a clay suspension. The second layer of material which is not expandable at the expansion temperature of the first clay material retains the form stability and may serve readily as a carrier for the first clay material during the expansion process so that additional casing material may be dispensed with in the manufacture of the light construction element.

Particularly advantageous expansion conditions result in radiation heating from above. The heat then acts immediately and intensely on the first clay material layer and effects rapid expansion which also results in initial sintering to the second clay material layer. Since this layer, however, is remote from the radiation heating it may be cooler, whereby the form stability of the second clay material layer during firing is improved. In case that radiation heating from above is not sufficient the blank may be heated additionally at its underside.

The light construction element thus manufactured is suitable for the most various purposes as, for example, as building bricks in non-load supporting walls or as a component in compound masonry. The light construction element, however, is of particular advantage as a cover plate to insulate existent masonry. As a cover plate the light construction element may be directly glued to other masonry. Specifically advantageous is, then, a design of the light construction containing a spherically shaped porosity generating agent. The visible surface of the clay material, then, may already be provided with a corresponding pattern during manufacture, for example, by profiling the same and/or color designing the same by engobing or glazing.

The light construction element is thus distinguished by high strength which is not only of great significance in using the same but also in transporting and processing the light construction element.

The oven according to the invention and for carrying out the method according to the invention contains an especially advantageous effective radiation heating wherein the radiation heating elements have an increasing distance from the conveying means in the conveying direction, i.e. are adapted to the progressing expansion process in the blanks.

The radiation heating elements may be fixedly arranged at a progressively increasing distance, such design being of advantage when, on the one hand, the expansion properties of the clay material are defined exactly and always the same and when the blank is conveyed through the oven preferably continuously. More advantageous, however, is a design including an elevational adjusting device since, then, the radiation heating elements may then be adapted to the respective expansion properties of the blanks. There, the radiation heating elements may be adjusted individually or, preferably, in groups. The latter design is of advantage, when the blanks are moved stepwise through the oven. Especially advantageous is a sensor-controlled adjustment since, then, intricate adjusting operations may be dispensed with and the radiation heating elements automatically adjust to the respective extent of expansion of the blanks.

In the case of radiation heating from above the oven is expediently additionally designed with a heating from below since particularly at a greater distance of the radiation heating elements from the conveying means the heat action on the second clay material layer may be insufficient, although the same is preferably maintained cooler.

As already mentioned a design of the oven including a step-wise operated conveyor is preferred since stepwise conveying of the blanks enables simpler adjustment of the radiation heating elements to the degree of expansion of the clay material. There, the conveying means may comprise a conveyor belt moved in steps.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figures 1, 2A, 2B, 2C:
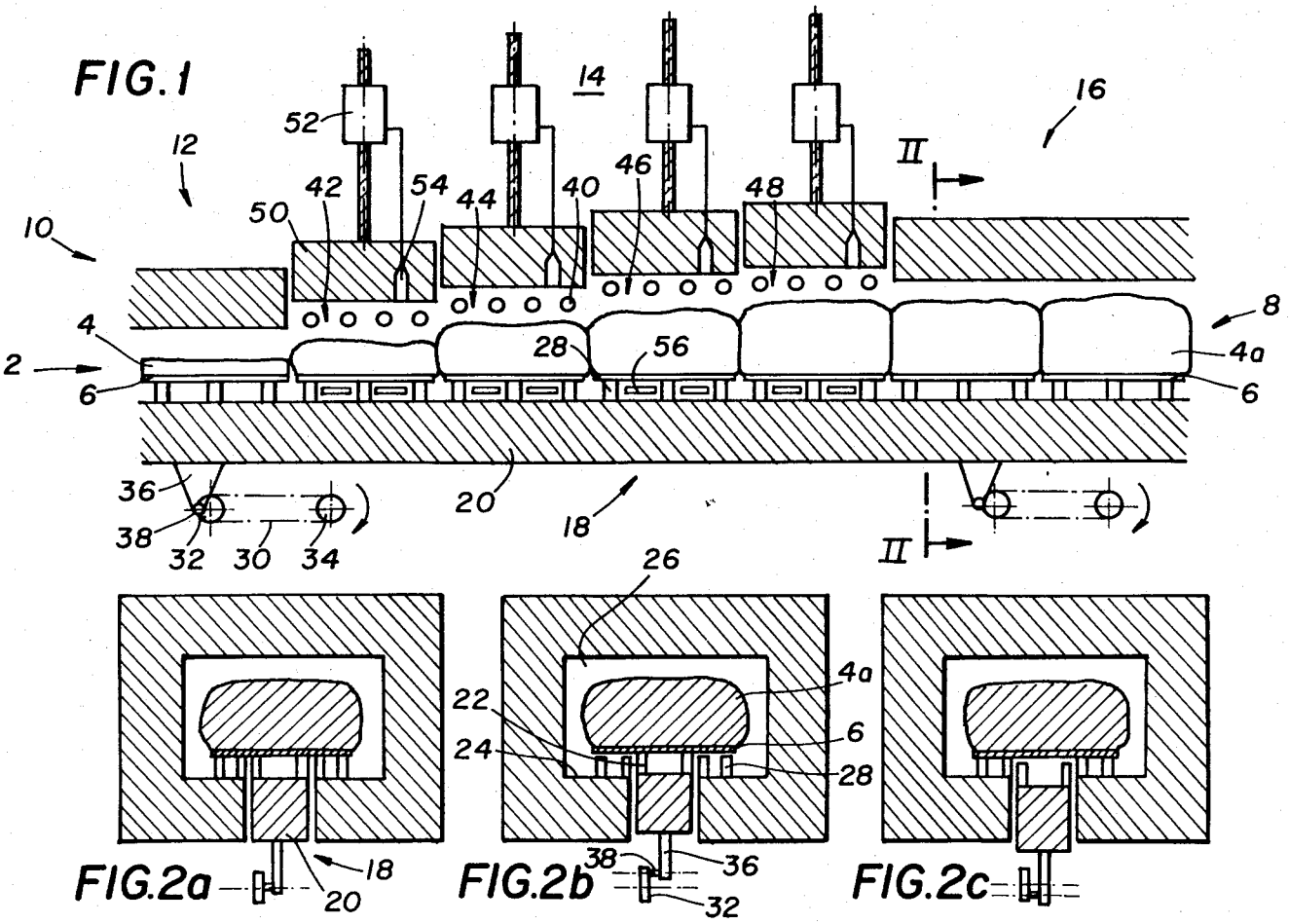
FIG. 1 is a longitudinal section of a part of the oven according to the invention.
FIGS. 2*a* to 2*c* is a in section along the line II—II in FIG. 1 three different conveying positions of the apparatus as shown in FIG. 1.

Describing now the drawings, it is to be understood that only enough of the construction of the oven has been shown as needed for those skilled in the art to readily understand the underlying principles and concepts of the present development, while simplifying the showing of the drawings.

The oven as illustrated in FIGS. 1 to 2*c* serves to fire a blank 2 which comprises a first layer 4 made of expandable clay material arranged on a second layer 6 consisting of a clay material which is not expandable at least in the range of the expansion temperature of the first clay material. This blank, for example, may be produced in a two-part extruder press, in which one extruder processes the first clay material and the second extruder processes the second clay material and in which both extruders operate to serve a common extruder head so that the blank is already obtained in a layered shape. Due to the high pressures in the extruder press the two layers 4 and 6 are already sufficiently bonded. The layered strand then will only have to be cut into blanks of the desired length. After firing a shaped body 8 is obtained comprising the second layer 6 which has retained its original shape and the layer 4*a* of the now expanded clay material. This shaped body 8 is caused to assume the desired shape and dimension by mechanical processing.

The oven 10, a section of which is shown in the Figures, comprises a pre-heating station 12, a firing station 14 and a cooling station 16. A conveyor device 18 serves to convey the blanks 2 through the stations.

In the present embodiment the conveying device 18 operates stepwise and comprises therefor a walking beam 20 provided with cams 22 on the upper side thereof on which the blank 2 rests. At the base 24 of the tunnel 26 of the oven 10 corresponding cams 28 are disposed on both sides of the walking beam 20. The walking beam is driven by two circulating chains 30 guided on wheels 32, 34 one of which is driven. The walking beam 20 includes arms 36 extending downwardly and connected to the chains 30 by bolts 38. When the arm 36 is moved along the upper run of the chain 30 by means of the bolt 38, the walking beam 20 is lifted above the resting plane of the cams 28 in the tunnel 26 and conveys the blanks 2 by one further step as will be evident from FIG. 2*b*. When the arm 36 with its bolt 38 is moved along the lower run of the chains 30, the walking beam 20 is returned by the conveying step below the resting plane of the cams 28 as will be evident from FIG. 2*c*. FIGS. 1 and 2*a* show the transition of the arms 36 and the bolts 38 from the return phase to the conveying phase.

While the oven 10 may be heated in the pre-heating station 12, for example, by means of heating gases, heating of the oven in the firing station 14 occurs by means of radiation heating elements 40 combined in four groups 42, 44, 46 and 48, each of which comprises the length of a conveying step or, respectively, the length of a blank 2. Each group of radiation heating elements 40 is arranged at an elevationally adjustable roof portion of the oven. Each roof portion 50 is provided with an adjusting device 52 to adjust the distance of the roof portion 50 and thus of the radiation heating elements 40 from the conveying means 18 or, respectively, from the blank 2 located thereon. To adapt the radiation heating elements 40 to the degree of expansion of the blank 2 located in each case therebelow, the adjusting device 52 is further provided with sensing means 54 which, for example, operate according to the principle of ultrasound and which sense the distance of the roof portion 50 and thus of the radiation heating elements from the expanded blank 2. The adjusting device 52 contains a not further indicated control device by means of which the desired distance to be observed may be adjusted. Preferably, the distance of the radiation heating elements from the expanding blanks is in the range of 40 to 60 mm.

In case that the heat developed by radiation heating elements is insufficient to fire the blank also in the lowest layer thereof, further heating elements 56 may be arranged intermediate the cams 28 for heating the underside of the blanks. Such heating elements may be provided at the base 24 of the tunnel 26 and/or at the walking beam 20.

In the successive cooling station 16 the shaped bodies obtained are gradually cooled by means of correspondingly conditioned gas.

With respect to further variations in the design reference is made to the claims and to the general description.

While there are shown and described present preferred embodiments of the invention, it is to be distinctly understood that the invention is not limited thereto, but may be otherwise variously embodied and practiced within the scope of the following claims.

Accordingly, what we claim is:

1. A method of manufacturing a light construction element, particularly a cover plate, comprising the steps of:

mold-free shaping a blank comprising a first layer in the form of a massive, dimensionally-stable body composed of a first clay material which is expandable on firing, a second layer composed of a second clay material which is non-expandable under the conditions of said firing of said first clay material, and an interface between said first layer and said second layer;

arranging the mold-free blank thus obtained such that said second layer forms a lower layer and supporting said mold-free blank by means of said lower layer thereof; and firing said mold-free blank while supporting the same by means of said lower layer thereof;

whereby said first layer composed of said first clay material is expanded and sintered to said second layer composed of said second clay material which is non-expandable under the conditions of said firing, at said interface formed between said first layer and said second layer.

2. The method as defined in claim 1, further including the step of:

utilizing as said first clay material a material which contains a porosity-generating agent.

3. The method as defined in claim 2, further including the step of:

utilizing as said first clay material a material which contains said porosity-generating agent in an amount of up to 45% by volume.

4. The method as defined in claim 2, further including the step of:

selecting styropor as said porosity-generating agent.

5. The method as defined in claim 2, further including the step of:

selecting as said porosity-generating agent a material which is composed of substantially spherically-shaped particles.

6. The method as defined in claim 5, further including the step of:

utilizing as said substantially spherically-shaped particles particles which have a particle size in the range of approximately 0.8 to 2.5 mm.

7. The method as defined in claim 1, further including the step of:

during said mold-free shaping of said blank pressing said first layer composed of said first clay material and said second layer composed of said second clay material.

8. The method as defined in claim 7, further including the step of:

performing said pressing of said first layer and said second layer by extruding said first clay material and said second clay material by means of an extruder press including a common extrusion head.

9. The method as defined in claim 1, further including the steps of:

performing said mold-free shaping of said blank using the following steps:

forming said massive dimensionally-stable body of said first layer from said first clay material which is expandable on firing, forming said second layer from said second clay material which is non-expandable under the conditions of said firing of said first clay material;

applying a clay material suspension to at least one of said first layer and said second layer; and superposing said first layer and said second layer with said formation of said interface therebetween in order to form said mold-free blank.

10. The method as defined in claim 1, further including the steps of:

using radiation heating means for said firing of said mold-free blank while supporting the same by means of its lower layer; and arranging said radiation heating means at least above said mold-free blank and at an at least approximately constant distance from said blank during said firing operation.

11. The method as defined in claim 10, further including the step of:

placing said radiation heating means at a distance from said blank in the range of about 40 to 60 mm.

12. A method of manufacturing a light construction element, particularly a cover plate, comprising the steps of:

mold-free shaping a blank comprising a first layer in the form of a massive, dimensionally-stable body composed of a first clay material which is expandable on firing, a second layer composed of a second clay material which is non-expandable under the conditions of said firing of said first clay material, and an interface between said first layer and said second layer;

arranging the mold-free blank thus obtained such that said first layer forms an upper layer and said second layer forms a lower layer and supporting said mold-free blank by means of said lower layer thereof;

placing said mold-free blank supported by means of said lower layer thereof at a predetermined distance from a radiative heat source; and applying radiative heat at least from above to said mold-free blank in order to fire the same;

whereby said first layer composed of said first clay material is expanded and sintered to said second layer composed of said second clay material which is non-expandable under the conditions of said applying of said radiative heat, at said interface formed between said first layer and said second layer.

* * * * *

UNITED STATES PATENT AND TRADEMARK OFFICE

CERTIFICATE OF CORRECTION

PATENT NO. : 4,493,805

DATED : January 15, 1985

INVENTOR(S) : GUSTAV-ADOLF SPORKENBACH et al

It is certified that error appears in the above-identified patent and that said Letters Patent is hereby corrected as shown below:

Column 2, line 35, please delete "as" (first occurrence)

Column 3, line 33, after "2c is a" please delete "in"

Column 4, line 2, please delete "therefor" and insert --therefore--

Signed and Sealed this

*Sixth* Day of *August 1985*

[SEAL]

*Attest:*

DONALD J. QUIGG

*Attesting Officer*

*Acting Commissioner of Patents and Trademarks*